US009863436B2

(12) United States Patent
Pedersen et al.

(10) Patent No.: US 9,863,436 B2
(45) Date of Patent: Jan. 9, 2018

(54) PUMP HOUSING

(71) Applicant: GRUNDFOS HOLDING A/S, Bjerringbro (DK)

(72) Inventors: Casper Pedersen, Skive (DK); Nicholas Pedersen, Randers NØ (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 622 days.

(21) Appl. No.: 14/377,282

(22) PCT Filed: Jan. 17, 2013

(86) PCT No.: PCT/EP2013/050861
§ 371 (c)(1),
(2) Date: Aug. 7, 2014

(87) PCT Pub. No.: WO2013/117402
PCT Pub. Date: Aug. 15, 2013

(65) Prior Publication Data

US 2015/0016980 A1 Jan. 15, 2015

(30) Foreign Application Priority Data

Feb. 8, 2012 (EP) ..... 12154493

(51) Int. Cl.
*F04D 1/00* (2006.01)
*F04D 29/42* (2006.01)
*F04D 15/00* (2006.01)

(52) U.S. Cl.
CPC ..... *F04D 29/428* (2013.01); *F04D 1/00* (2013.01); *F04D 15/0088* (2013.01); *F04D 29/426* (2013.01)

(58) Field of Classification Search
CPC ..... F04D 1/00; F04D 15/0088; F04D 27/001; F04D 29/426
USPC ..... 415/118
See application file for complete search history.

(56) References Cited

FOREIGN PATENT DOCUMENTS

| | | | | |
|---|---|---|---|---|
| DE | 19544173 C1 * | 6/1997 | ..... | F04D 15/0088 |
| DE | 196 47 967 A1 | 5/1998 | | |
| DE | 19647967 B4 * | 10/2005 | ..... | F04D 15/00 |
| EP | 0 774 583 A1 | 5/1997 | | |
| EP | 0774583 A1 * | 5/1997 | ..... | F04D 15/0088 |

(Continued)

OTHER PUBLICATIONS

DE19647967B4 Machine Translation. Accessed EPO website Jan. 20, 2017.*

*Primary Examiner* — Richard Edgar
(74) *Attorney, Agent, or Firm* — McGlew and Tuttle, P.C.

(57) ABSTRACT

A pump housing has a spiral housing and includes a suction channel (14) which runs out in a space (15). The space (15) is for arranging an impeller (6), rotatable about a rotation axis (5), and includes a spirally peripheral channel (16) open to the space (15) and running out into a pressure channel. A receiver (20) for a differential pressure sensor is provided within the pump housing. A first sensor channel (22) is provided, which connects the receiver (20) to a pressure-side interior of the pump housing. A second sensor channel (23) connects the receiver (20) to the pressure-side interior of the pump housing. The receiver (20) for the differential pressure sensor is arranged between the spirally peripheral channel (16) and the suction channel (14), so that the channels can be formed by way of simple bores.

19 Claims, 6 Drawing Sheets

(56) References Cited

FOREIGN PATENT DOCUMENTS

| | | |
|---|---|---|
| EP | 1 413 768 A1 | 4/2004 |
| EP | 1 413 769 A1 | 4/2004 |

* cited by examiner

PUMP HOUSING

CROSS REFERENCE TO RELATED APPLICATIONS

This application is a United States National Phase Application of International Application PCT/EP2013/050861 filed Jan. 17, 2013 and claims the benefit of priority under 35 U.S.C. §119 of European Patent Application EP 12154493.6 filed Feb. 8, 2012, the entire contents of which are incorporated herein by reference.

FIELD OF THE INVENTION

The invention relates to a pump housing or a centrifugal pump with a pump housing of a spiral housing construction type with a suction channel running out into a space which is designed for arranging an impeller that is rotatable about a rotation axis and comprises a spirally peripheral channel open to the space and running out into a pressure channel, with a receiver for a differential pressure sensor and with sensor channels.

BACKGROUND OF THE INVENTION

Pump housings of the spiral housing construction type discussed here are applied in technology in a diverse manner. Such pump housings are used for heating circulation pumps for example which nowadays are often equipped with electronic speed controllers which open up an extended field of application. Even if the operating conditions of the pump are detected via the electrical data of the motor, however a differential pressure measurement is normally necessary for inclusion into a closed-loop control and this measurement detects at least the pressure difference between the suction side and the pressure side of the pump. In order to avoid external pipework and long conduit connections, it is counted as belonging to the state of the art, to attach such a differential pressure sensor on the pump housing itself.

From EP 0 774 583 A1, it is known to provide an assembly basis next to the pressure connection and connection flange, on a rib of the pump housing, and this assembly basis comprises a bore projecting into the rib, as a receiver for the differential pressure sensor. This bore is connected via channels to the suction port of the pump on the one hand, and to the pressure channel in the region of the connection flange on the other hand.

One disadvantage of this known arrangement is the fact that the channels in the pump housing consisting typically of a casting must be included in this casting, which requires some effort with regard to tooling technology and in particular necessitates the application of lost cores which means significant costs, in particular with large-scale manufacture.

SUMMARY OF THE INVENTION

Against this state of the art, it is the object of the invention to design a pump housing of the known type, with a receiver for a differential pressure sensor, such that with regard to manufacturing technology, this pump housing is more economical to produce. Moreover, the pressure measurement on the pressure side, where possible, is to be effected at a location, in which one the one hand the pressure largely corresponds to the conduit pressure actually prevailing at the exit side of the pump, but which on the other hand permits an unambiguous as possible quantity assignment in the HQ-diagram.

According to the invention, a pump housing of the spiral housing construction type is provided. The pump housing comprises a pressure channel, an impeller space and a suction channel running out into the impeller space, which is designed for arranging an impeller rotatable about a rotation axis. The impeller space comprises a spirally shaped peripheral channel open from a portion of the impeller space and running out into the pressure channel. The housing further comprises a receiver for a differential pressure sensor, a first sensor channel, which connects the receiver to a suction-side interior of the pump housing and a second sensor channel, which connects the receiver to a pressure-side interior of the pump housing. The receiver for the differential pressure sensor is arranged between the spirally peripheral channel and the suction channel.

The pump housing according to the invention is a housing of the spiral housing construction type and comprises the suction channel which runs out in a space which is designed for the arrangement of an impeller therein. The impeller is rotatable about a rotation axis. The impeller space has the spirally shaped peripheral channel open to the impeller space, specifically the spiral cannel which surrounds the impeller and runs out into a pressure channel. The pump housing comprises the receiver for a differential pressure sensor and is provided with the first sensor channel which connects the receiver to the suction-side interior of the pump housing as well as with the second sensor channel which connects the receiver to the pressure-side interior of the pump housing. According to the invention, the receiver for the differential pressure sensor is arranged in the region between the spirally peripheral channel and the suction channel Such an arrangement is particularly advantageous, since channels which run in a straight line can be formed with the casting-technology shaping as well as material-removing shaping, and these channels are comparatively simple to manufacture with regard to manufacturing technology. Moreover, the arrangement according to the invention permits a pressure-side pressure measurement in a region which is particularly advantageous, as will yet be explained in detail further below.

The basic concept of the solution according to the invention is to provide a receiver for a differential pressure sensor in the pump housing, said receiver being arranged such that it can be led into the interior of the pump housing with straight-lined channels, specifically on the one hand to the suction side and on the other hand to the pressure side. Thereby, with the arrangement according to the invention, the receiver can lie selectively within the pump housing or also outside on the pump housing, be it only as an assembly base or also with channels running out at the outside on the pump housing. Particularly advantageously, the receiver according to the invention however lies within the pump housing, as is explained yet in detail further below.

With regard to manufacturing technology, it is particularly favorable if according to a further development of the invention, the sensor channels are formed by bores in the housing. Such bores can be manufactured in an inexpensive manner, in particular since such types of pump housings which are typically of a casting, as a rule, need to be post-machined in a material-removing manner in any case.

Advantageously, not only the sensor channels, but also the receiver is formed by a bore in the housing. Thereby, the second sensor channel can advantageously run out transversely to the bore forming the receiver, whereas the first sensor channel according to an advantageous further development of the invention is arranged in a continuation of the bore forming the receiver, preferably aligned thereto, thus with the receiver is designed as a stepped bore.

Thereby, it is particularly favorable if the first sensor channel, thus the sensor channel which connects the suction side within the pump housing to the receiver, is arranged essentially perpendicularly to the rotation axis of the impeller. Advantageously, the second sensor channel which connects the receiver to the pressure side within the pump housing, is arranged essentially parallel to the rotation axis of the impeller. In combination this results in the sensor channels meeting one another perpendicularly and being arranged with their axes such that they lie where surfaces are to be machined in a material-removing manner in any case.

It is particularly advantageous if the second sensor channel runs out in the pressure-side peripheral region of the impeller, and specifically there, especially close to the end of the spirally peripheral channel which runs out into the pressure channel Surprisingly, it has been found that the pressure detection is indeed particularly advantageous in this region, since on the one hand an unambiguous assignment to the flow rate as a rule is possible and on the other hand the pressure measured there very closely approximates the static pressure which actually prevails at the exit of the pump.

Thereby, it is particularly advantageous if, according to a further development of the invention, the bore forming the second sensor channel is manufactured through a preferably central housing opening, with which the pump housing connects to a motor housing and through which the impeller is introduced into the pump housing. This opening which is present in any case and which as a rule is to be machined in a likewise material-removing manner, permits a bore which is arranged parallel to the rotation axis of the impeller and which can run out transversely to the bore forming the receiver. Thus one can create a bore, with which no end needs to be closed, as would have to be effected for example if this bore were to be introduced from the outside through the housing wall.

Advantageously, the bore forming the second sensor channel is led through a wall covering the impeller to the housing opening. With regard to this housing opening, it is the case of the previously described one, through which the impeller is introduced into the pump housing.

The bore forming the second sensor channel can advantageously also be drilled from the outside into the pump housing.

If the receiver is formed by a bore in the pump housing, it is advantageous if a plane surface extending transversely to the bore axis and being able to serve as a bearing-contact surface for a sensor housing, is provided at the outer end of this bore. A threaded bore can be provided parallel to the bore axis, in this plane surface, in order to fasten a sensor housing on the plane surface with a screw.

Basically, the fastening can be provided via a second threaded bore, so that a sensor housing can be fastened at both sides of the bore on the plane surface. According to an advantageous further development of the invention however, a support formed preferably by a groove and for one end of a holding bracket for a sensor housing receiving a differential sensor, is formed next to the plane surface and perpendicularly thereto, and the other end of this holding bracket can be fastened by way of a screw in the threaded bore. In this manner, one can make do without a second threaded bore, and the sensor housing integrated below the plane surface is held in a secure manner with a positive and non-positive fit by way of the holding bracket which is supported on the one hand in the groove and on the other hand is held on the plane surface with a positive and non-positive fit by the screw.

The differential pressure sensor itself is advantageously inserted into the bore forming the receiver amid the integration of a sealing cap, so that it does not come into direct contact with the fluid via the sensor bores, but in an indirect manner. The sealing cap at the same time ensures that no fluid can get into the bore forming the receiver. With this design, it is advantageous if the differential pressure sensor is arranged in a projecting cylindrical section of the sensor housing seated on the plane surface and projecting with the projecting cylindrical section into the bore forming the receiver. This sensor housing is advantageously fastened on the plane surface on the housing by way of the holding bracket.

The invention is hereinafter explained in more detail by way of the embodiment example of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 2:
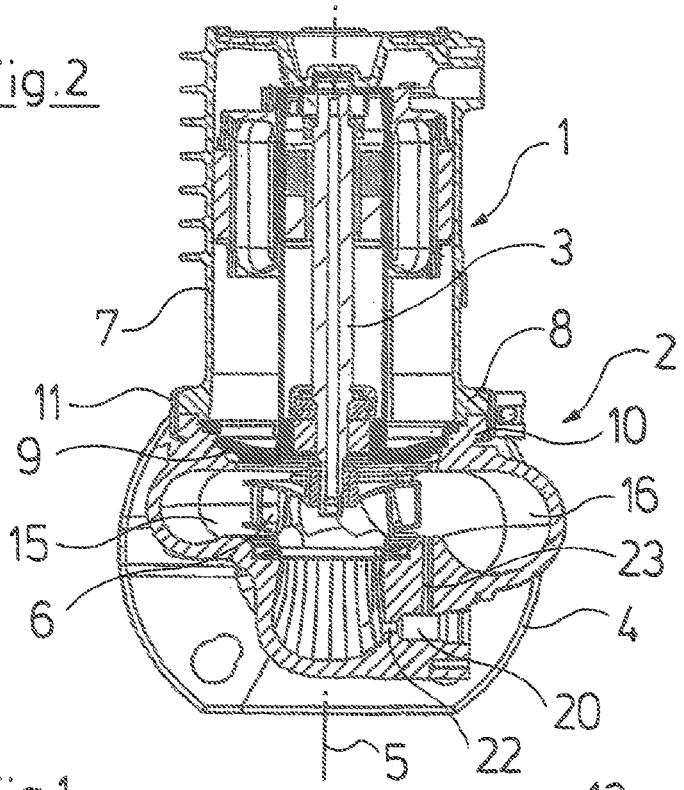
FIG. 2 is a sectional view along the section line II-II in FIG. 1.
Figure 1:
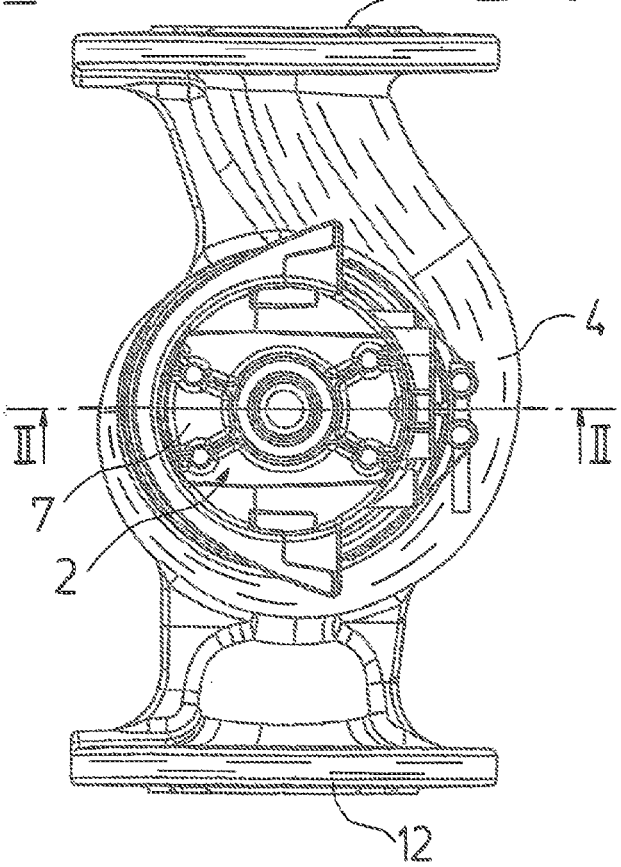
FIG. 1 is a greatly simplified schematic lateral view showing a centrifugal pump with a connected electric motor.
Figure 3:
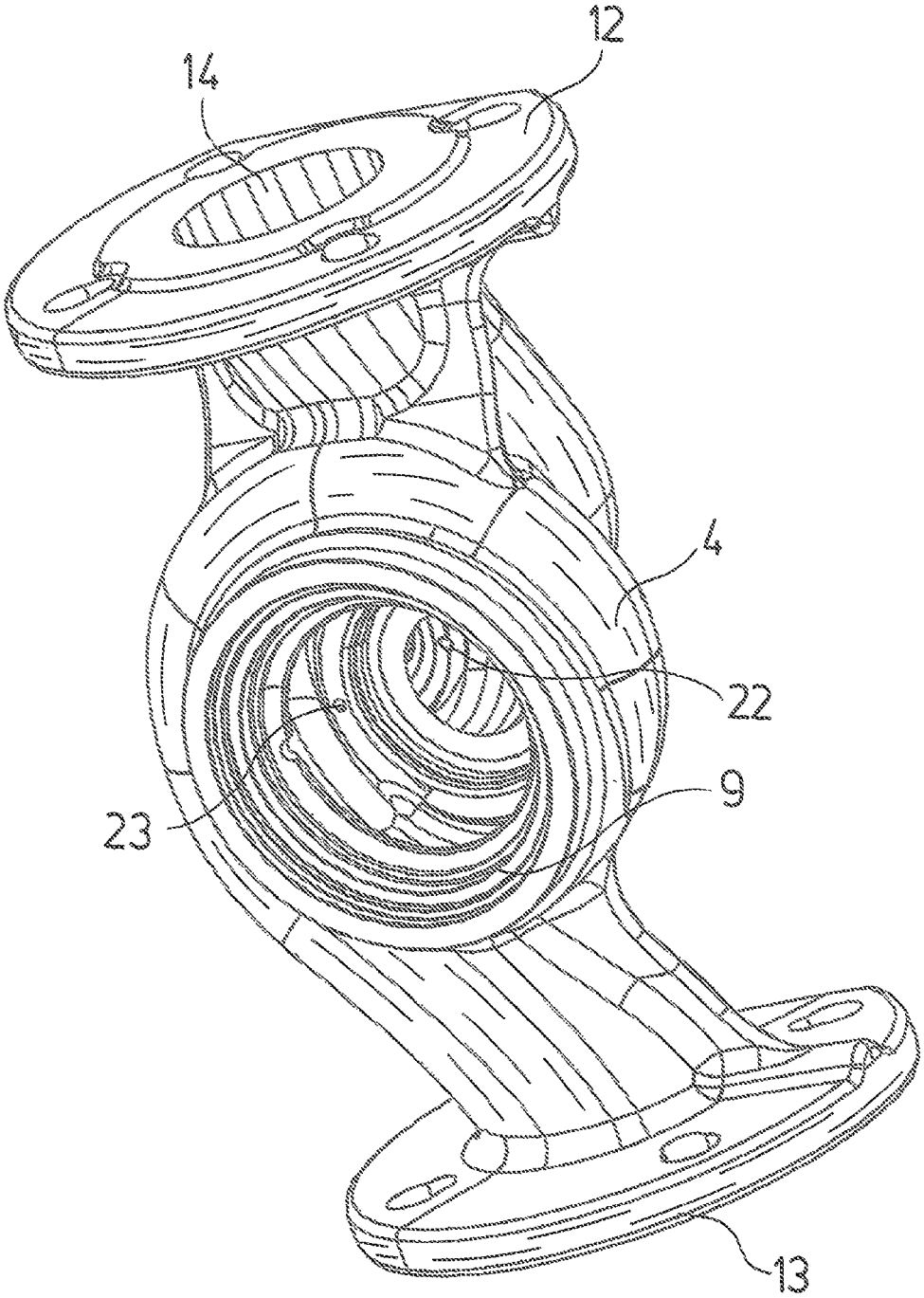
FIG. 3 is a perspective representation showing the pump housing of the centrifugal pump according to FIG. 1.
Figure 4:
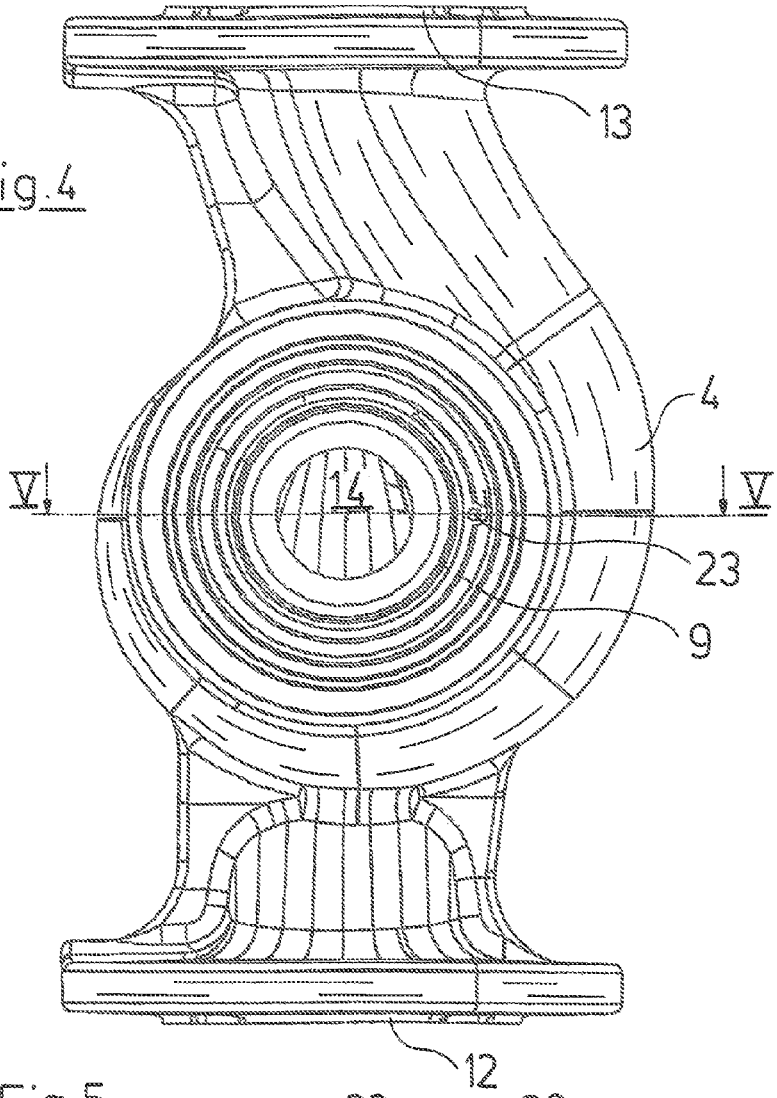
FIG. 4 is a lateral view of the pump housing according to the representation according to FIG. 1, without motor and impeller.
Figure 5:
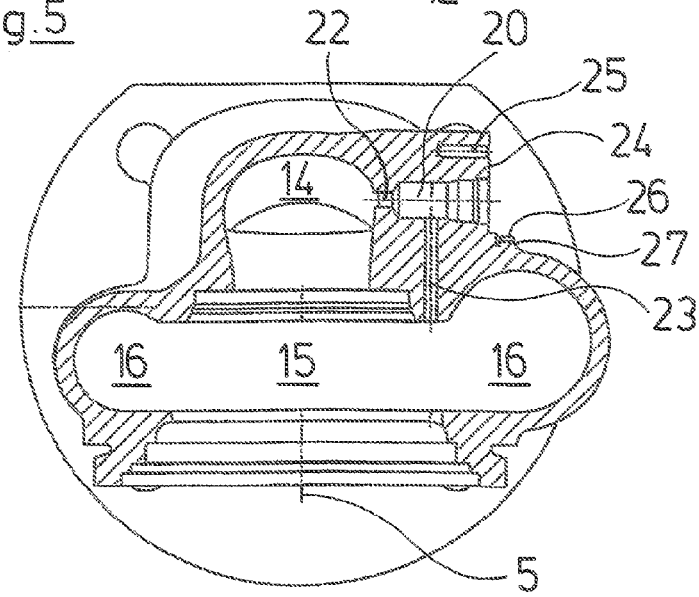
FIG. 5 is a sectional view along the section line V-V in FIG. 4.

Referring to the drawings in particular, the centrifugal pump assembly represented in the FIGS. 1 and 2 consists of a centrifugal pump 1 with an electric motor 2 which is connected thereto and which via a shaft 3 drives an impeller 6 arranged in the pump housing 4 in a rotatable manner about a rotation axis 5. The electric motor 2 is represented without a terminal box and the motor electronics located therein, including the electronic sped controller, for reasons of a better overview.

The electric motor 2 comprises a motor housing 7 which towards the pump 1 is provided with a flange 8 on the periphery and via a centring projection engages into a central housing opening 9 of the pump housing 4, said pump housing in this region likewise being provided with a flange 10 peripherally of the opening 9. The motor housing 7 and the pump housing 4 are connected to one another with positive fit and non-positive fit via the flanges 8, 10 which are encompassed by a clamping ring 11.

With regard to the pump housing 4, it is the case of an inline housing, i.e. the suction connection 12 and a pressure connection 13 are aligned to one another. The pump housing 4 is designed as a spiral housing and comprises a suction channel 14 which departs from the suction connection 12 and runs out in a space 15, in which the impeller 6 is arranged, as is represented by way of FIG. 2. This space 15 for the impeller is surrounded by a spirally widening and peripheral spiral channel 16 which is open to the space 15 and which runs out into a pressure channel 17 ending at the suction connection 12. The housing construction thus corresponds to the basic housing construction of an inline pump of the spiral housing construction type.

A receiver 20 in the form of a bore is provided within the pump housing 4, for receiving a differential pressure sensor which is arranged a projecting section 18 of a sensor housing 19. The bore 20 is provided for receiving this projecting section 18 amid the integration of a sealing cap 21. The section 18 of the sensor housing 19 is designed such that pressure forces can be detected through the sealing and elastic cap 21 via the end-side end-face on the one hand as well as a side-face on the other hand.

The receiver 20 is designed as a stepped bore, i.e. the bore with a smaller diameter continues at the end of the receiver 20 and there forms a first sensor channel 22 which runs out in the suction channel 14. This first sensor channel 22 thus connects the suction channel 14 to the receiver 20 for the differential pressure sensor. The bore 20 forming the receiver as well as the first sensor channel 22 connecting thereto lie in a plane transverse to the rotation axis 5 of the impeller 6. In the present embodiment example, the longitudinal middle axis of the sensor channel 22 and the rotation axis 5 intersect.

A second sensor channel 23 which connects the receiver 20 for the differential pressure sensor to the pressure-side interior of the pump housing, in particular to the space 15, is formed by a bore which is arranged parallel to the rotation axis 5 of the impeller 6. This bore is introduced through the central housing opening 9 and runs out in the space 15, as is particularly to be deduced from FIG. 2, next to the impeller 6 within the space 15 surrounded by the spiral channel 16, and specifically, with respect to the rotation axis 5 and the flow direction, at about 45° in front of the location at which the spiral channel 16 runs out into the pressure channel 17.

As the above embodiments shown, the receiver 20 for the differential pressure sensor is arranged between the spirally running channel 16 and the suction channel 14, so that the necessary conduit connections within the pump housing 4 can be created by way of simple bores, specifically the first sensor channel 22 and the second sensor channel 23. Thereby, it has been surprisingly found that the run-out of the second sensor channel 23 between the impeller 6 and the spiral channel 16 is particularly advantageous with regard to measurement technology, since when measuring in this region, the determined pressure values very closely approach the static pressure at the pressure connection 13, but on the other hand an unambiguous assignment with regard to the flow rate values is possible.

In the above described embodiment example, the receiver 20 for the differential pressure sensor is arranged within the pump housing 4, but can however also lie outside of the pump housing. The term "between the spirally peripheral channel 16 and the suction channel 14" is therefore to be understood in the broad sense and encompasses a region which permits the suction-side and the pressure-side space of the pump housing 4 to be reached with straight-lined bores from a location in or on the pump housing 4.

Figure 6:
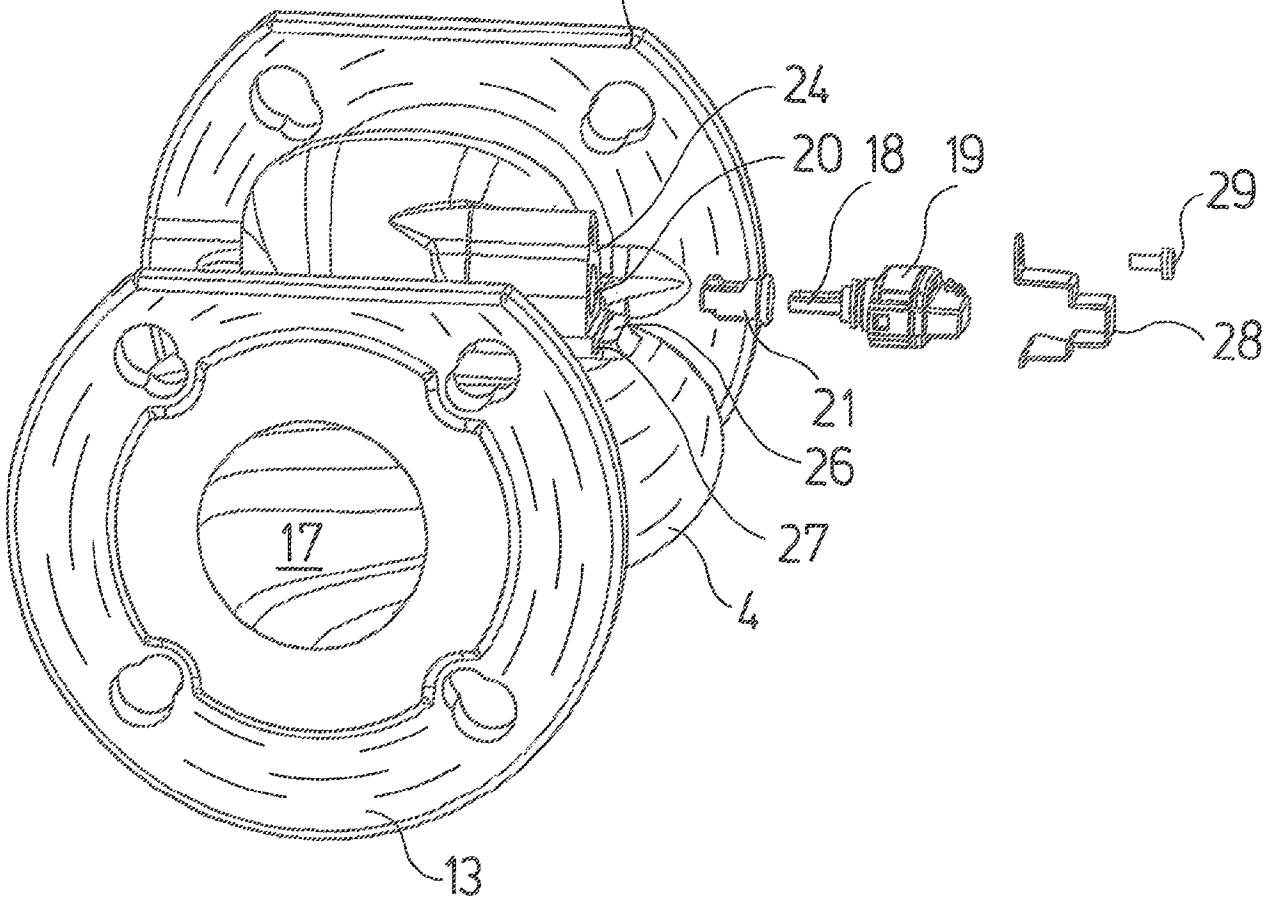
FIG. 6 is a perspective exploded representation showing the pump housing according to the previous figures, with a differential pressure sensor and associated components.
Figure 7:
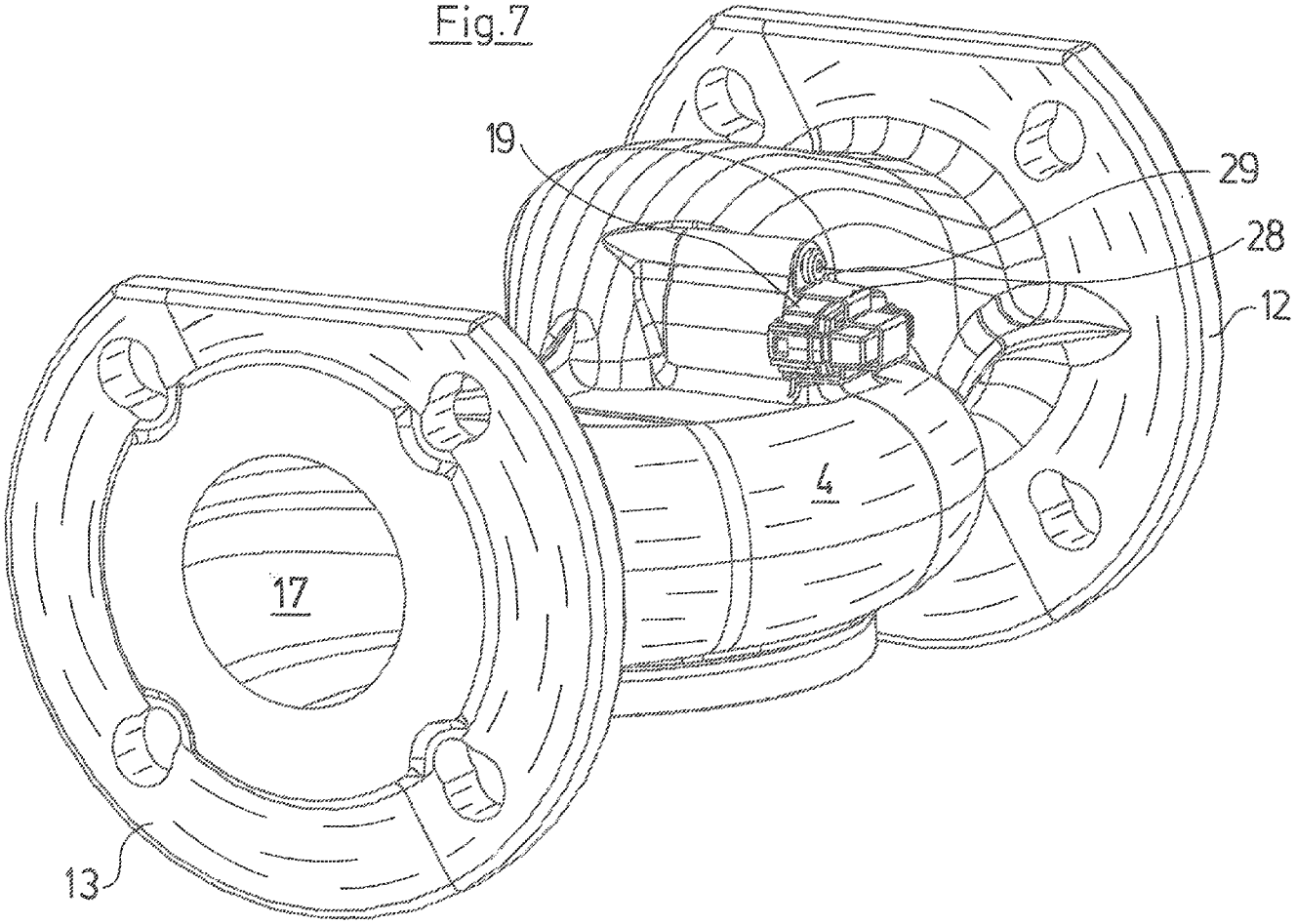
FIG. 7 is a perspective representation of the pump housing with an installed differential pressure sensor.

With the previously described embodiment, as is to be particularly deduced from FIG. 6, a plane surface 24 on the outer side of the pump housing is provided at the outer end of the receiver 20 in a manner perpendicular to this, and a threaded bore 25 arranged next to the receiver 20 is provided in this plane surface. Moreover, a plane surface 26 arranged perpendicularly to the plane surface 24 is provided on the outer side of the pump housing 4 at the height of the spiral channel 16, into which plane surface a groove 27 is milled. The plane surfaces 24 and 26 serve for the bearing-contact of the sensor housing 19 which is fastened on the pump housing 4 by way of a holding bracket 28 which with one end is supported in the groove 27 and with its other end is fastened on the pump housing by way of a screw 29 which is engaged into the threaded bore 25.

The run-out of the sensor channel 23 is arranged at an angle $\alpha$ of 90° in the embodiment example represented by way of FIGS. 1 to 7. The angle $\alpha$ is determined by the longitudinal middle axis 30 of the pump housing and the rotation axis 5 of the impeller 6, and in the representation according to FIG. 8, is thus anticlockwise in the direction of the rotation axis 5 towards the motor.

Figure 8:
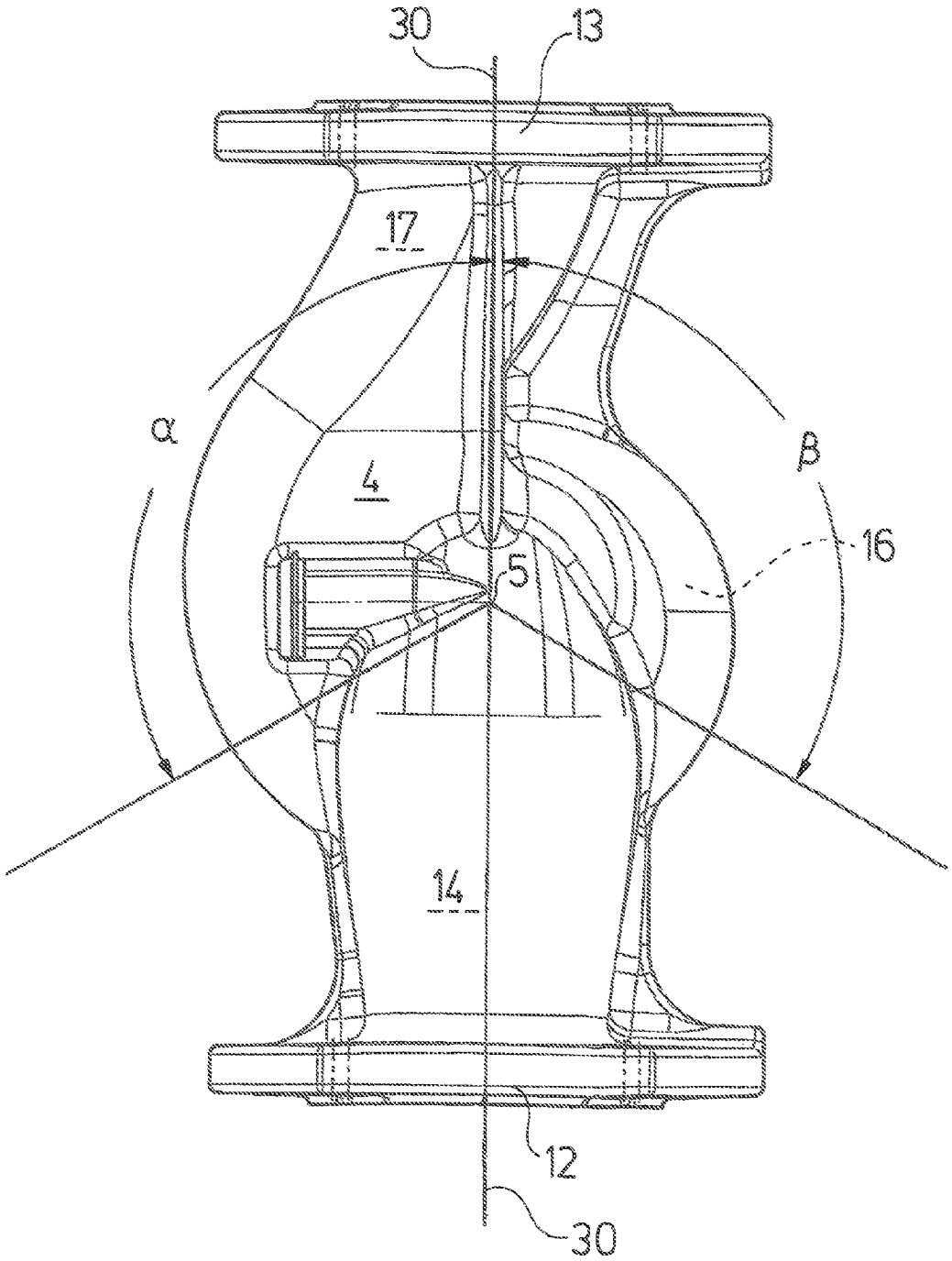
FIG. 8 is a side view of the pump housing from the side away from the motor.

The invention is not limited to this angle $\alpha$ is equal to 90°, but can be arranged in angular regions $\alpha$ between 0° and 120° anticlockwise as well as in angular regions $\beta$ of 0° to 120° clockwise, as this is represented by way of FIG. 8. The run-out thereby advantageously lies between the spirally peripheral channel 16 and the impeller, thus a flow region influenced by the spiral channel. Thereby, it has been found that if the opening for the channel 23 is arranged in a region $\beta$ between 0° and 120°, on measurement, Q/H curves result, which in the lower region interest the Q/H curve as is measured between the connections 12 and 13 of the pump, whereas in the angle region between 0° and 120° Q/H curves result, which lie almost completely below the Q/H curve as is measured between the connections 12 and 13.

While specific embodiments of the invention have been shown and described in detail to illustrate the application of the principles of the invention, it will be understood that the invention may be embodied otherwise without departing from such principles.

The invention claimed is:

1. A pump housing of the spiral housing construction type, the pump housing comprising:

a pressure channel;

an impeller space;

a suction channel running out into the impeller space, which is designed for arranging an impeller rotatable about a rotation axis, wherein the impeller space comprises a spirally shaped peripheral channel open from a portion of the impeller space and running out into the pressure channel;

a receiver for a differential pressure sensor;

a first sensor channel which connects the receiver to a suction-side interior of the pump housing; and a second sensor channel which connects the receiver to a pressure-side interior of the pump housing, wherein the receiver for the differential pressure sensor is arranged between the spirally peripheral channel and the suction channel, and the second sensor channel ends in the spirally shaped peripheral channel, the second sensor channel being formed by a bore, wherein the bore forming the second sensor channel is manufactured through a housing opening, with which housing opening the pump housing connects to a motor housing and through which housing opening the impeller is introduced into the pump housing.

2. A pump housing according to claim 1, wherein the first sensor channels is formed by another bore in the housing.

3. A pump housing according to claim 1, wherein the receiver is formed by another bore in the housing.

4. A pump housing according to claim 3, wherein the second sensor channel runs out transversely to the another bore forming the receiver.

5. A pump housing according to claim 3, wherein:

the first sensor channel is formed by a portion of the another bore;

the portion of the another bore forming the first sensor channel is arranged in a continuation of the another bore forming the receiver in a manner aligned to the another bore forming the receiver.

6. A pump housing according to claim 1, wherein the first sensor channel is arranged essentially perpendicularly to the rotation axis of the impeller.

7. A pump housing according to claim 1, wherein the second sensor channel is arranged essentially parallel to the rotation axis of the impeller.

8. A pump housing according to claim 1, wherein the second sensor channel runs out in a pressure-side peripheral region of the impeller.

9. A pump housing according to claim 1, wherein the second sensor channel runs at an end of the spirally peripheral channel which runs out into the pressure channel.

10. A pump housing according to claim 1, wherein the bore forming the second sensor channel is led through a wall covering the impeller, the wall being on a diametrically opposite side of the impeller space relative to the housing opening.

11. A pump housing according to claim 1, wherein:

the bore forming the second sensor channel is drilled into the pump housing from the outside.

12. A pump housing according to claim 1, wherein:

the receiver is formed by another bore in the housing;

a plane surface extending transversely to a bore axis of the receiver is provided on an outer end of the another bore forming the receiver.

13. A pump housing according to claim 12, wherein a threaded bore is provided in the plane surface, parallel to the bore axis of the receiver.

14. A pump housing according to claim 13, wherein: a support is formed by a groove and is for one end of a holding bracket for a sensor housing receiving the differential pressure sensor;

the support is formed next to the plane surface and perpendicularly thereto; and another end of said holding bracket can be fastened in the threaded bore by way of a screw.

15. A pump housing according to claim 1, further comprising a sealing cap, wherein the differential pressure sensor is inserted into another bore forming the receiver amid an integration of the sealing cap.

16. A pump housing according to claim 14, wherein the differential pressure sensor is arranged in a projecting section of the sensor housing which is seated on the plane surface, projects with the projecting section into the another bore forming the receiver and is fastened on the plane surface on the housing by way of the holding bracket.

17. A pump housing according claim 1, in combination with an impeller to form a wet-running centrifugal pump, with the impeller rotatably mounted in the pump housing.

18. A pump housing of the spiral housing construction type, the pump housing comprising:

a pressure channel;

an impeller space;

a suction channel running out into the impeller space, which is designed for arranging an impeller rotatable about a rotation axis, wherein the impeller space comprises a spirally shaped peripheral channel open from a portion of the impeller space and running out into the pressure channel;

a receiver for a differential pressure sensor;

a first sensor channel which connects the receiver to a suction-side interior of the pump housing; and a second sensor channel which connects the receiver to a pressure-side interior of the pump housing, wherein the receiver for the differential pressure sensor is arranged between the spirally peripheral channel and the suction channel, and the second sensor channel ends in the spirally shaped peripheral channel, the receiver being formed by a bore in the housing, wherein a plane surface extending transversely to a bore axis of the receiver is provided on an outer end of the bore forming the receiver, wherein a threaded bore is provided in the plane surface, parallel to the bore axis of the receiver, wherein a support is formed by a groove and is for one end of a holding bracket for a sensor housing receiving the differential pressure sensor, the support being formed next to the plane surface and perpendicularly thereto, wherein another end of the holding bracket can be fastened in the threaded bore by way of a screw.

19. A pump housing of the spiral housing construction type, the pump housing comprising:

a pressure channel;

an impeller space;

a suction channel running out into the impeller space, which is designed for arranging an impeller rotatable about a rotation axis, wherein the impeller space comprises a spirally shaped peripheral channel open from a portion of the impeller space and running out into the pressure channel;

a receiver for a differential pressure sensor;

a first sensor channel which connects the receiver to a suction-side interior of the pump housing; and a second sensor channel which connects the receiver to a pressure-side interior of the pump housing, wherein the receiver for the differential pressure sensor is arranged between the spirally peripheral channel and the suction channel, and the second sensor channel ends in the spirally shaped peripheral channel, the receiver being formed by a bore in the housing, wherein a plane surface extending transversely to a bore axis of the receiver is provided on an outer end of the bore forming the receiver, wherein a threaded bore is provided in the plane surface, parallel to the bore axis of the receiver, wherein a support is formed by a groove and is for one end of a holding bracket for a sensor housing receiving the differential pressure sensor, the support being formed next to the plane surface and perpendicularly thereto, wherein another end of the holding bracket can be fastened in the threaded bore by way of a screw, the differential pressure sensor being arranged in a projecting section of the sensor housing which is seated on the plane surface, projects with the projecting section into the bore forming the receiver and is fastened on the plane surface on the housing by way of the holding bracket.

* * * * *